US008654157B2

(12) United States Patent
Yamato et al.

(10) Patent No.: US 8,654,157 B2
(45) Date of Patent: Feb. 18, 2014

(54) IMAGE DISPLAY DEVICE AND IMAGE DISPLAY METHOD

(75) Inventors: Asahi Yamato, Osaka (JP); Kohzoh Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 175 days.

(21) Appl. No.: 13/393,797

(22) PCT Filed: Aug. 11, 2010

(86) PCT No.: PCT/JP2010/063643
§ 371 (c)(1),
(2), (4) Date: Mar. 1, 2012

(87) PCT Pub. No.: WO2011/033888
PCT Pub. Date: Mar. 24, 2011

(65) Prior Publication Data

US 2012/0162229 A1 Jun. 28, 2012

(30) Foreign Application Priority Data

Sep. 15, 2009 (JP) ..... 2009-213571

(51) Int. Cl.
*G09G 5/10* (2006.01)

(52) U.S. Cl.
USPC ..... 345/690; 345/89; 345/214

(58) Field of Classification Search
USPC ..... 345/77, 89, 204, 214, 428, 690
See application file for complete search history.

(56) References Cited

U.S. PATENT DOCUMENTS

2002/0033813 A1 3/2002 Matsumura et al.
2004/0189568 A1 9/2004 Lee et al.
2005/0162360 A1* 7/2005 Ishihara et al. ..... 345/89
2007/0040779 A1 2/2007 Baba et al.
2008/0129672 A1 6/2008 Ishihara
2008/0180424 A1* 7/2008 Ishihara ..... 345/204
2008/0309601 A1* 12/2008 Furukoshi ..... 345/89
2009/0135123 A1* 5/2009 Yamato et al. ..... 345/94
2009/0207163 A1* 8/2009 Yamato et al. ..... 345/214
2009/0262124 A1* 10/2009 Yamamoto et al. ..... 345/565
2009/0267884 A1* 10/2009 Takahashi et al. ..... 345/96
2009/0289968 A1* 11/2009 Yoshida ..... 345/691
2010/0002017 A1 1/2010 Hongo et al.
2010/0020110 A1 1/2010 Yamato

FOREIGN PATENT DOCUMENTS

JP 2002-99249 A 4/2002
JP 2006-113359 A 4/2006
JP 2006-514755 A 5/2006
JP 2007-52127 A 3/2007

(Continued)

*Primary Examiner* — Joe H Cheng
(74) *Attorney, Agent, or Firm* — Chen Yoshimura LLP

(57) ABSTRACT

Disclosed is an image display device including an image signal input section (2), an overshoot operation section (3) that, when an image signal is inputted from outside one frame at a time, corrects the gradation level of the inputted image signal for a frame, a frame memory (4) that stores the corrected image signal of the frame, and a sub-frame division processing section (5) that time-divides the corrected and stored image signal of the frame into a plurality of sub-frame periods. The overshoot operation section (3) corrects the gradation level of an image signal of a frame according to a relation between the corrected gradation level of the image signal of a frame immediately preceding the frame, which is stored of the frame memory (4), and the gradation level of the image signal of the frame. Thus, the costs can be reduced, the device can be made compact, and the power consumption can be suppressed.

14 Claims, 4 Drawing Sheets

(56) References Cited

FOREIGN PATENT DOCUMENTS

| | | | |
|---|---|---|---|
| JP | 2008-292704 | A | 12/2008 |
| WO | 2004/086350 | A1 | 10/2004 |
| WO | 2006/098244 | A1 | 9/2006 |
| WO | 2008/035486 | A1 | 3/2008 |
| WO | 2008/117623 | A1 | 10/2008 |

* cited by examiner

IMAGE DISPLAY DEVICE AND IMAGE DISPLAY METHOD

TECHNICAL FIELD

The present invention relates to an image display device that performs sample-and-hold display and a method of displaying images with such an image display device.

BACKGROUND ART

In recent years, liquid crystal display devices and organic EL (electroluminescence) display devices are in wide use in televisions and monitors of personal computers and the like. Conventionally, sample-and-hold type display devices such as liquid crystal display devices or organic EL display devices have a problem of so-called motion blur, a phenomenon where, when a moving image is displayed, a boundary between portions having different display luminance is perceived as blurry. This is a phenomenon unique to the sample-and-hold type display devices, which occurs because the display data written the last time is held until the next display data is written.

One method of preventing the motion blur is a so-called double-speed driving technology, where one frame of an inputted image signal is divided into a plurality of sub-frames to mimic the impulse display. In this technology, a signal divided into multiple sub-frames is written on a pixel in multiple times. Here, the motion blur can be suppressed by reducing the luminance of at least one of the sub-frames to a low level (close to a black display).

Besides the motion blur, liquid crystal displays also have a problem of a slow response of liquid crystal elements. That is, in the liquid crystal display device, when the input gradation level changes over consecutive frames, the luminance response level after the change may not reach the input gradation level. A technology used to compensate for the slow response time of the liquid crystal elements is an overshoot driving.

With the overshoot driving, in response to the rise or fall of the inputted gradation change, a voltage that is higher or lower than the voltage actually applied for the gradation level is applied on the liquid crystal elements to fast drive the liquid crystal elements in a forced manner. A technology where the double-speed driving and overshoot driving are combined is disclosed in Patent Document 1, for example.

FIG. 5 is a block diagram showing the configuration of the image display device of Patent Document 1. In the image display device 100 of Patent Document 1, once an image signal, where the signal of each frame period is represented by a gradation level, is inputted to a memory controller 12, the inputted image signal is divided into sub-frames according to the timing signal generated by a timing controller 11. Next, a first gradation level conversion unit 13 detects a location of a luminance change in consecutive frames of the inputted image signal, and performs an overshoot driving to improve the response time in the frame immediately after the detected luminance change. Then, based on the signal whose gradation level is corrected by the overshoot driving, the second gradation level conversion unit and the third gradation level conversion unit convert the gradation levels in the sub-frames and output them to the image display panel 20.

RELATED ART DOCUMENTS

Patent Documents

Patent Document 1: WO 2006-098244 (publication date: Sep. 21, 2006)

SUMMARY OF THE INVENTION

Problems to be Solved by the Invention

As described above, the motion blur and the slow response time of the image display device can be improved with the double-speed driving and the overshoot driving. However, it is hard to say that the conventional image display devices provide a satisfactory solution when considering their costs and size reduction possibility.

The present invention was devised in consideration of the problem described above, and is aiming at providing an image display device that can be manufactured at a reduced cost, can be made compact, and is energy-efficient.

Means for Solving the Problems

In order to solve the problem, an image display device of the present invention is:

an image display device that time-divides one frame period of an image signal into a plurality of sub-frame periods to display images, including:

an inputting unit into which the image signal is inputted from outside one frame at a time;

a correction unit that corrects a gradation level of the inputted image signal for a frame;

a storage unit that stores the corrected gradation level of the image signal of the above-mentioned frame; and a frame division unit that time-divides the corrected and stored image signal of the above-mentioned frame into the plurality of sub-frame periods, wherein the storage unit already is storing the corrected gradation level of the image signal of a frame immediately preceding the above-mentioned frame when the correction unit corrects the gradation level of the image signal of the above-mentioned frame, and wherein the correction unit corrects the gradation level of the image signal of the above-mentioned frame in accordance with the relation between the corrected gradation level of the image signal of the frame immediately preceding the above-mentioned frame and the gradation level of the image signal of the above-mentioned frame.

In the configuration described above, an image display device of the present invention includes the correction unit that corrects the gradation level of the inputted image signal, and the frame division unit that divides one frame period of the image signal into a plurality of sub-frame periods. Consequently, the slow response time of the display elements can be improved and the motion blur can be suppressed when the corrected image signal is outputted to, for example, a display panel.

In the present invention, when an image signal of a frame is inputted, the correction unit corrects the gradation level of the image signal of the frame according to the relation between the gradation level of the image signal of the above-mentioned frame and the gradation level of the image signal of a frame immediately preceding the above-mentioned frame. That is, the correction unit corrects the gradation level of the inputted image signal according to the gradation levels in consecutive frames. At this time, the gradation level of the image signal of the frame immediately preceding the above-mentioned frame is already corrected and stored in the storage unit. When the correction unit corrects the gradation level of the image signal of the above-mentioned frame, the corrected image signal of the above-mentioned frame is then stored in the storage unit.

Also, the image signal that the frame division unit divides into a plurality of sub-frames is the corrected image signal of the above-mentioned frame, which is stored in the storage unit. That is, in the image display device of the present invention, the corrected image signal of the frame immediately preceding the above-mentioned frame, which the correction unit retrieves when performing the correction, corresponds to the corrected image signal of the above-mentioned frame, which the frame division unit retrieves to generate a plurality of sub-frames. Thus, because the image signal that the correction unit retrieves and the image signal that the frame division unit retrieves are both the image signal of one display (one frame) after all, the storage unit only needs to have a capacity for one display. Therefore, unlike conventional image display devices, the memory does not need to have a capacity for two displays for the double-speed driving and the overshoot driving. Therefore, the costs can be reduced and the device can be made compact.

Further, in an image display device of the present invention, because a frame is divided into sub-frames after the image signal is corrected, correction can be conducted fewer times compared to the method in which the gradation level is corrected after the frame is divided into sub-frames. Thus, the power consumption of the device can be reduced.

Image Display Method

In order to solve the problem described above, a method of displaying images according to the present invention is:

a method of displaying images, wherein one frame period of an image signal is time-divided into a plurality of sub-frame periods to display images, including the steps of:

inputting the image signal from outside one frame at a time;

correcting the gradation level of the inputted image signal for a frame;

storing the corrected gradation level of the image signal of the above-mentioned frame; and time-dividing the corrected and stored image signal of the above-mentioned frame into the plurality of sub-frame periods, wherein in the correction step, the storage unit for storing the corrected gradation level of the image signal of the above-mentioned frame already is storing the corrected gradation level of the image signal of the frame immediately preceding the above-mentioned frame when correcting the gradation level of the image signal of the above-mentioned frame, and wherein in the correction step, correction is conducted in accordance with the relation between the corrected gradation level of the image signal of the frame immediately preceding the above-mentioned frame, which is stored in the storage unit, and the gradation level of the image signal of the above-mentioned frame.

In a method of displaying images according to the above configuration of the present invention, the gradation level of the inputted image signal is corrected, and one frame period of the image signal is time-divided into a plurality of sub-frame periods. Consequently, the slow response time of the display elements can be improved and the motion blur can be suppressed when the corrected image signal is outputted to, for example, a display panel.

Also, in the image display method of the present invention, the image signal gradation level for a frame is corrected first, and then the corrected image signal of the frame is stored in the memory. Next, the corrected and stored image signal of the frame is retrieved to be divided into sub-frames. Thus, because a frame is divided into sub-frames after the image signal is corrected, the correction is conducted fewer times compared to the method in which the gradation level is corrected after the frame is divided into sub-frames. Thus, the power consumption of the device can be reduced.

Effects of the Invention

An image display device of the present invention is an image display device in which one frame period of an image signal is divided into a plurality of sub-frame periods to display images. The image display device includes: an inputting unit to which the image signal is inputted from outside one frame at a time; a correction unit that corrects the gradation level of the inputted image signal for a frame; a storage unit that stores the corrected image signal of the above-mentioned frame; and a frame division unit that time-divides the corrected and stored image signal of the above-mentioned frame into the plurality of sub-frame periods, wherein when the correction unit corrects the gradation level of the image signal of the above-mentioned frame, the storage unit already stores the corrected image signal of the frame immediately preceding the above-mentioned frame, and the correction unit corrects the gradation level of the image signal of the above-mentioned frame according to the relation between the corrected gradation level of the image signal of the frame immediately preceding the above-mentioned frame, which is stored in the storage unit, and the gradation level of the image signal of the above-mentioned frame. Thus, the costs can be reduced, the device can be made compact, and the power consumption can be suppressed.

DETAILED DESCRIPTION OF EMBODIMENTS

Embodiments of the image display device according to the present invention are described below with reference to FIGS. 1 to 4.

Configuration of the Image Display Device

Figure 1:
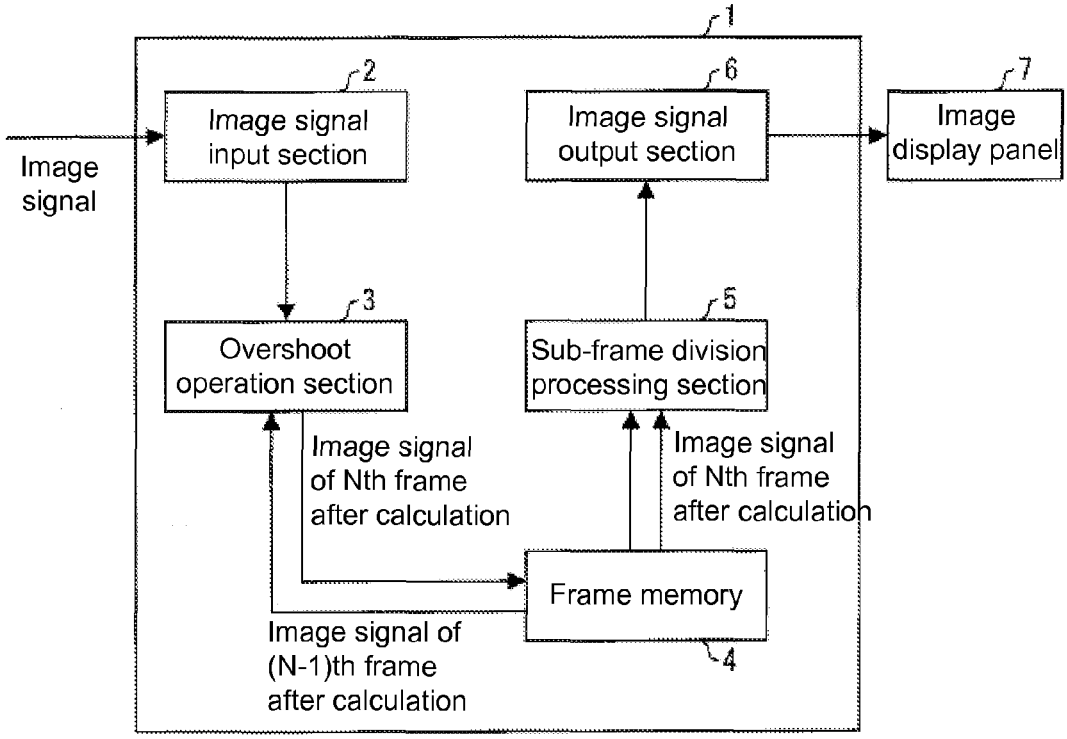
FIG. 1 is a block diagram showing the configuration of an image display device according to an embodiment of the present invention.

FIG. 1 is a block diagram showing the configuration of the image display device according to an embodiment of the present invention. As shown in FIG. 1, an image display device 1 according to the present embodiment includes: an image signal input section (inputting unit) 2; an overshoot operation section (correction unit) 3; a frame memory (storage unit) 4; a sub-frame division processing section (frame division unit) 5; and an image signal output section (display unit) 6.

The image display device 1 is an image display device that performs the double-speed driving and overshoot driving. That is, in the image display device 1, the gradation level of the inputted image signal is corrected first, and then one frame period of the image signal is divided into a plurality of sub-frame periods. Thus, the slow response time of the display elements can be improved and the motion blur can be suppressed when the corrected image signal is outputted to the image display panel 7.

Upon receipt of an image signal inputted from outside, the image signal input section 2 outputs the image signal to the overshoot operation section 3. The image signal, although not especially limited, is inputted from a device externally connected, such as a content delivery device or a personal computer.

The overshoot operation section 3 corrects the inputted image signal gradation level for a frame. Specifically, upon receipt of an image signal of a frame (hereinafter also referred to as "Nth frame") from the image signal input section 2, the overshoot operation section 3 retrieves the image signal of a frame immediately preceding the Nth frame, which signal is stored in the frame memory 4 (hereinafter also referred to as "(N−1)th frame"). Here, the image signal of the (N−1)th frame, which is stored in the frame memory 4, refers to an image signal whose gradation level has already been corrected at the overshoot operation section 3. Therefore, the overshoot operation section 3 corrects the gradation level of the image signal of the Nth frame according to the relation between the gradation level of the image signal of the Nth frame which was received from the image signal input section 2 and the corrected gradation level of the image signal of the (N−1)th frame.

The frame memory 4 stores the image signal of the Nth frame whose gradation level has already been corrected at the overshoot operation section 3. Specifically, the frame memory 4 holds the image signal of the (N−1)th frame until the corrected image signal of the Nth frame is sent from the overshoot operation section 3. That is, in this specification, when the image signal of the next frame is inputted to the overshoot operation section 3 while the corrected image signal of the Nth frame is stored in the frame memory 4, the image signal of the next frame is now considered as the image signal of the Nth frame, and the image signal of the Nth frame stored in the frame memory 4 is considered as the image signal of the (N−1)th frame.

The sub-frame division processing section 5 divides the corrected image signal of the Nth frame, which is stored in the frame memory 4, into a plurality of sub-frame periods and converts the gradation level into that for the sub-frames.

The image signal output section 6 outputs the image signal divided into sub-frames to the image display panel 7.

Process Flow of the Image Display Device

Figure 2:
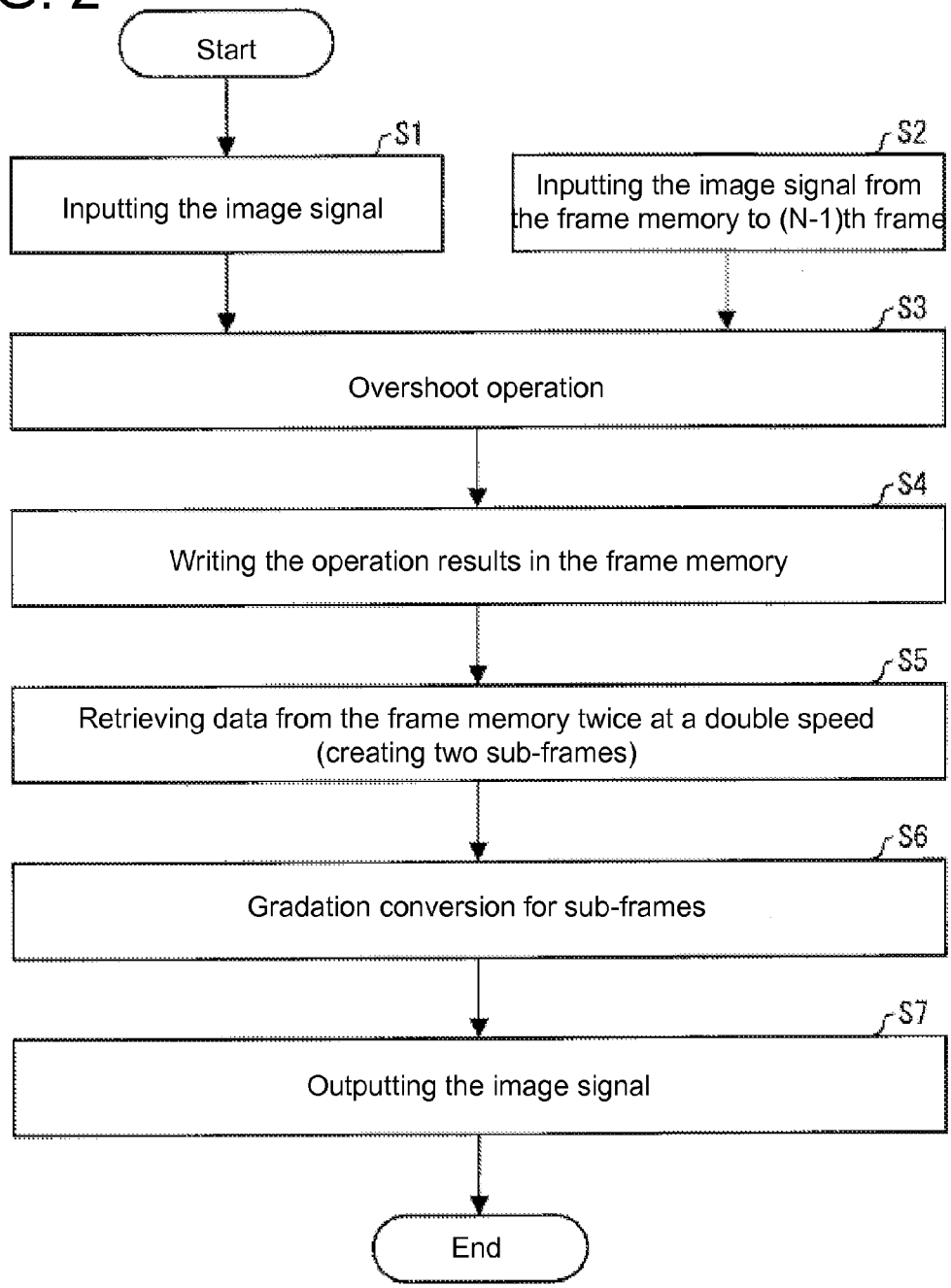
FIG. 2 is a flow chart showing the flow of the processes conducted by the image display device shown in FIG. 1.

Next, the flow of main processes conducted by the image display device 1 according to the present embodiment is described. FIG. 2 is a flowchart showing the flow of the processes conducted by the image display device 1.

First, when an image signal of the Nth frame is inputted from outside to the image signal input section 2 (Step S1), the overshoot operation section 3 retrieves the image signal of the (N−1)th frame from the frame memory 4 (Step S2). Based on the relation between the gradation level of the retrieved image signal of the Nth frame and the gradation level of the image signal of the (N−1)th frame, the overshoot operation section 3 calculates a gradation level for the image signal of the Nth frame (Step S3). The overshoot operation section 3 writes the image signal of the Nth frame whose gradation level was obtained, i.e., the corrected image signal of the Nth frame, to the frame memory 4 (Step S4).

Next, the sub-frame division processing section 5 retrieves the corrected image signal of the Nth frame twice at a double frequency from the frame memory 4 (Step S5). Thus, two sub-frames are created. The sub-frame division format is not limited to this, however. For example, one frame period may also be divided into three or more sub-frames. Also, the sub-frame division ratio is not especially limited. It may be 1:1, 2:1, or 3:1.

Based on the corrected image signal gradation level of the Nth frame, the sub-frame division processing section 5 converts the gradation levels of the image signals of the respective sub-frames (Step S6). The image signal output section 6 outputs the image signals of the respective sub-frames, where the gradation levels have been converted, to the image display panel 7 (Step S7). This way, images are displayed on the image display panel 7. The image display panel 7 may be a liquid crystal display, for example.

Thus, in the image display device 1, the image signal of the (N−1)th frame retrieved for the gradation level correction and the image signal of the Nth frame retrieved to generate sub-frames are both image signals for the same display.

Generally, when one frame of an image signal inputted into the image display device is divided into multiple frames, i.e., when a double-speed driving is performed, the image signal of the Nth frame, for example, is retrieved multiple times at a desired frequency. Here, because the image signal of the Nth frame is to be retrieved from the frame memory, the frame memory needs to have a space to store the image signal of the Nth frame for the double-speed driving.

Also, when the overshoot driving is performed to correct the gradation level of the image signal of the Nth frame, which has been divided into sub-frames, the image signal of the (N−1)th frame, which is the frame immediately prior to the Nth frame, is used to compare the gradation levels between the consecutive frames. Therefore, the image display device needs a space in the frame memory for storing the image signal of the (N−1)th frame.

Therefore, a conventional image display device that performs the double-speed driving and the overshoot driving needs image signals for two displays; one in the Nth frame, which is for the double-speed driving, and the other in the (N−1)th frame, which is for the overshoot driving. This means that the frame memory needs to have additional capacity to store the extra data.

In contrast, in the case of an image display device 1 of the present embodiment, the image signal of the (N−1)th frame, against which the gradation level of the image signal of the Nth frame is compared, is the corrected image signal of the (N−1)th frame that is retrieved to be divided into sub-frames. The frame memory 4, therefore, only needs to store the image signal for one display. That is, both the double-speed driving and the overshoot driving can be performed with a frame memory of a single display capacity.

Figure 3:
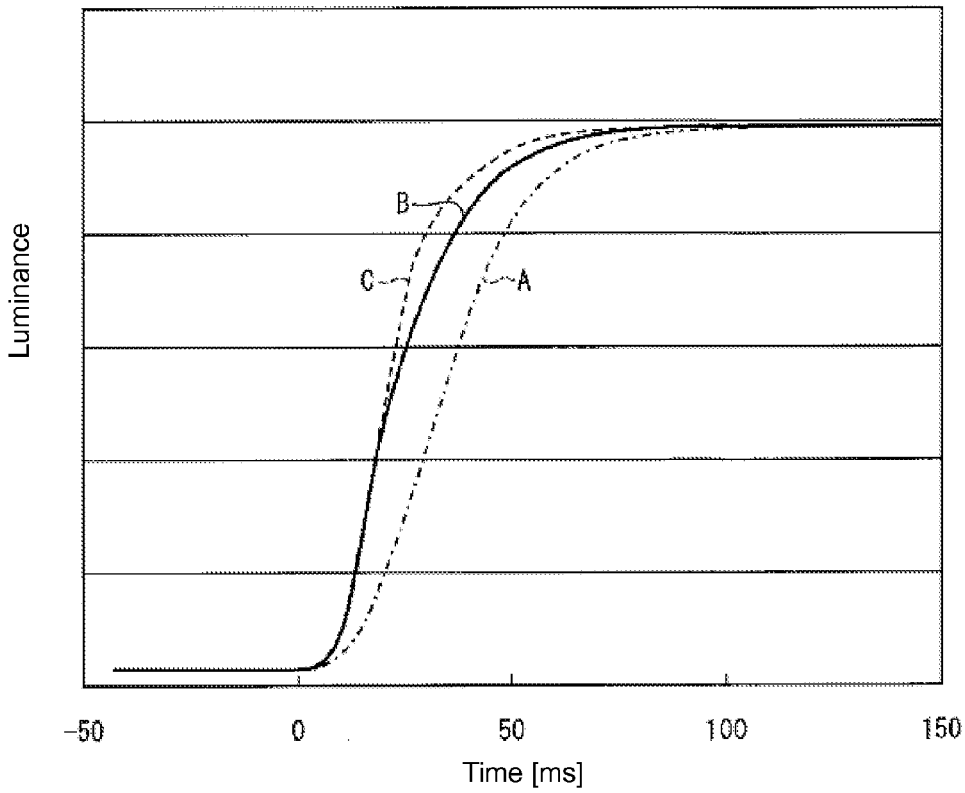
FIG. 3 is a graph comparing response times between different gradation levels.

FIG. 3 is a graph showing the response time comparison between certain gradation levels. In this graph, "A" represents the waveform of the response time when the gradation level is not corrected. "B" represents the waveform of the response time of the image display device 1 after the gradation level is corrected, and "C" represents the waveform of the response time of a conventional image display device after the gradation level is corrected. As shown in FIG. 3, the gradation level correction by the image display device 1 according to the present embodiment provides the correction effect equivalent to that of the conventional image display device.

Thus, the image display device 1 according to the present embodiment can reduce the frame memory costs and reduce the size of the device while maintaining the correction effect equivalent to that of the conventional image display device.

Further, in the image display method according to the present embodiment, the image signal gradation level of the Nth frame is corrected first, and then the corrected image signal of the Nth frame is stored in the memory. Next, the corrected image signal of the Nth frame stored in the memory is retrieved to be divided into sub-frames. Thus, because a frame is divided into sub-frames after the image signal is corrected, the correction is conducted fewer times compared to the method in which the gradation level is corrected after the frame is divided into sub-frames. Thus, the power consumption of the device can be reduced.

Correction of the Gradation Level

As described above, upon receipt of the image signal of the Nth frame, the overshoot operation section 3 retrieves the image signal of the (N−1)th frame stored in the frame memory 4 to correct the image signal of the Nth frame.

Here, gradation level correction refers to the correction that drives a pixel whose gradation level changes between consecutive frames faster and to make the response time shorter. Specifically, depending on the rise or the fall of the input gradation level between consecutive frames, the gradation level of the image signal is corrected so that a voltage higher or lower than the voltage provided for the actual gradation level is applied to the liquid crystal element. This way, the liquid crystal elements are fast driven in a forced manner. A table may be used for the signal correction conducted at the overshoot operation section 3.

This table preferably relates the image signal gradation levels of the Nth frame and the image signal gradation levels of the (N−1)th frame to the corrected image signal gradation levels for the Nth frame. For example, a table may be set up with the corrected gradation level values obtained in advance so that once the gradation level of the image signal of the Nth frame and the gradation level of the image signal of the (N−1)th frame are inputted, the inputted data is converted to a corrected gradation level of the Nth frame and is outputted. Thus, the gradation level can efficiently be corrected.

That is, in the overshoot driving, when an image signal inputted to the image display device 1 has different gradation levels between consecutive frames, the response time of the liquid crystal element can be improved by applying a voltage higher than the voltage for the actual gradation level if the gradation level of the Nth frame is greater than the gradation level of the (N−1)th frame, or by applying a voltage smaller than the voltage for the actual gradation level if the gradation level of the Nth frame is smaller than the gradation level of the (N−1)th frame.

Here, in the image display device 1 according to the present embodiment, because the corrected image signal of the (N−1) th frame is used as the image signal against which comparison is conducted for the overshoot driving, the gradation level to which the correction is targeted may not be obtained.

Figure 4:
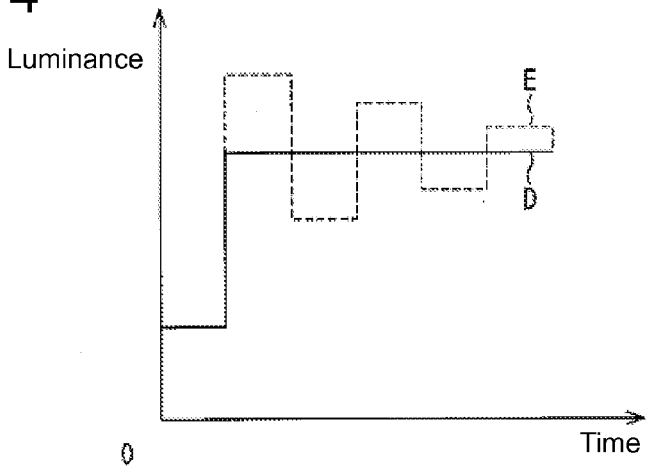
FIG. 4 is a graph showing the changes in the gradation level when the overshoot driving causes an oscillation.
Figure 5:
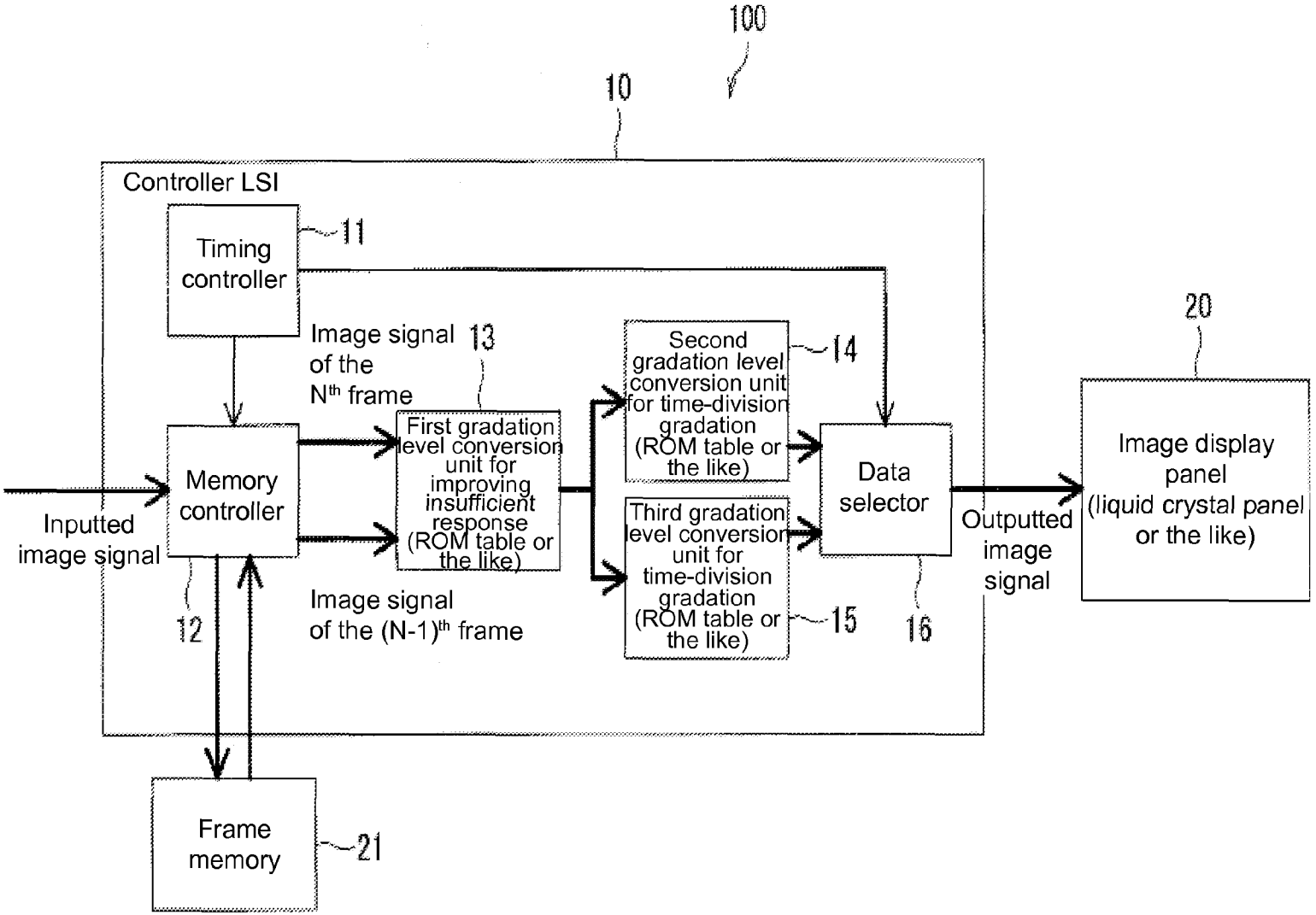
FIG. 5 is a block diagram showing the configuration of a conventional image display device.

For example, as shown in FIG. 4, the gradation level of an actually inputted image signal, which is indicated with a solid line "D", changes over time as illustrated. FIG. 4 is a graph showing the changes in the gradation level when the oscillation takes place in the overshoot driving. In the image display device 1 of the present embodiment, when the gradation level of the image signal rises sharply, a gradation level higher than that is outputted as the corrected value (this is represented by a dotted line "E" in FIG. 4).

Then, even though the gradation level of the actual image signal does not change, because the overshoot operation section 3 performs the correction by comparing the corrected gradation level, i.e., the value higher than the actual gradation level, with the gradation level of the actual image signal, a value lower than the actual gradation level is outputted as the correction value.

Further, another corrected value is outputted based on the comparison result of the gradation level of the inputted image signal and corrected gradation level. Consequently, even though the gradation level of the inputted image signal does not actually change, as shown in FIG. 4, the corrected gradation level may rise and fall. This causes an oscillation, and once the oscillation occurs, the effect of the overshoot driving cannot be fully obtained.

Therefore, if the correction can be performed to emphasize the difference in the gradation level only either when the gradation level of the Nth frame is higher than the gradation level of the (N−1)th frame or when the gradation level of the Nth frame is lower than the gradation level of the (N−1)th frame, the oscillation can be prevented from occurring, and an easy-to-view display can be obtained. To achieve this goal, a table can be set as described below.

For example, the table is preferably populated such that if the image signal gradation level of the Nth frame is higher than the image signal gradation level of the (N−1)th frame, a value that emphasizes the change in the image signal gradation level of the Nth frame is provided, and if the image signal gradation level of the Nth frame is lower than the image signal gradation level of the (N−1)th frame, the same gradation level as the image signal of the Nth frame is provided. The value that emphasizes the change in the gradation level of the image signal of the Nth frame refers to a value that is set higher than the gradation level of the actually inputted image signal of the Nth frame.

According to this table setting, if the image signal gradation level of the later frame of two consecutive frames is higher than that of in the earlier frame, correction is performed so that the gradation level of the later frame becomes higher than the actual gradation level, and if the later image signal gradation level is lower than that of the earlier frame, the gradation level is left unchanged. This way, oscillation is prevented from occurring, and an easier-to-view display can be obtained.

The setting for correcting the gradation level to prevent the oscillation is not limited to this. Another possible setting is that if the image signal gradation level of the Nth frame is higher than the image signal gradation level of the (N−1)th frame, the same gradation level as the image signal of the Nth frame is inputted, and if the image signal gradation level of the Nth frame is lower than the image signal gradation level of the (N−1)th frame, a value that emphasizes the change in the image signal gradation level of the Nth frame is inputted. The table setting may be changed as appropriate depending on the characteristics of the image display panel 7.

For example, if the image display panel 7 is a normally black type and provides a black screen when no voltage is applied, as described above, a table populated with values that emphasize the change from a low gradation level of the image signal of the (N−1)th frame to a high gradation level of the image signal of the Nth frame may be used.

On the other hand, if the image display panel 7 is a normally white type and provides a white screen when no voltage is applied, a table containing values that emphasize the change from a high gradation level of the image signal of the (N−1)th frame to a low gradation level of the image signal of the Nth frame may be used.

As a result, correction errors can be reduced, oscillation can be prevented from occurring, and the effect of the response time improvement can be enhanced in a manner suitable to the liquid crystal characteristics of the liquid crystal display to be used.

The method of correcting the gradation level in the image display device 1 is not limited to the one where a table is used.

A judgment unit (not shown), for example, may also be included. In this case, the judgment unit determines the magnitude relation between the gradation level of the image signal of the Nth frame and the gradation level of the image signal of the (N−1)th frame, and the gradation level of the Nth frame is corrected based on the judgment result.

That is, the overshoot operation section 3 may correct the gradation level of the image signal of the Nth frame in such a manner as to emphasize the change in the gradation level if the judgment unit determines that the gradation level of the image signal of the Nth frame is higher than the gradation level of the image signal of the (N−1)th frame, and corrects the gradation level of the image signal of the Nth frame to the same gradation level if the judgment unit determines that the gradation level of the image signal of the Nth frame is not higher than the gradation level of the image signal of the (N−1)th frame.

Similarly, the overshoot operation section 3 may correct the image signal of the Nth frame in such a manner as to emphasize the change in the gradation level if the judgment unit determines that the gradation level of the image signal of the Nth frame is lower than the gradation level of the image signal of the (N−1)th frame, and correct the image signal of the Nth frame to the same gradation level if the judgment unit determines that the gradation level of the image signal of the Nth frame is not lower than the gradation level of the image signal of the (N−1)th frame.

Further, the overshoot operation section 3 may include a judgment unit that determines the difference between the gradation level of the image signal of the Nth frame and the gradation level of the image signal of the (N−1)th frame such that the gradation level of the image signal of the Nth frame is not corrected and remains at the same gradation level if the difference between the gradation level of the image signal of the Nth frame and the gradation level of the image signal of the (N−1)th frame is determined to be within 0 to 12% of the total gradation.

This way, the lowering of the moving image quality due to the correction errors can be prevented without using any tables.

The image display device 1 may further include a temperature detection unit (not shown) that detects the ambient environmental temperature. In this case, the overshoot operation section 3 preferably corrects the gradation level of the image signal of the Nth frame according to the detected ambient environmental temperature.

That is, because the response time of the liquid crystal elements depends on the temperature, the liquid crystal elements can be driven in a more suitable manner by correcting the gradation level of the image signal according to the detected temperature.

Other Table Examples

The table used by the overshoot operation section 3 is not limited to those described above. A table populated such that the same gradation level as the image signal of the Nth frame is provided if the difference between the gradation level of the image signal of the Nth frame and the gradation level of the image signal of the (N−1)th frame is within 0 to 12% of the total gradation, for example, may be used.

That is, if the difference in the gradation level between the image signal of the Nth frame and the image signal of the (N−1)th frame is small, the moving image quality is considered not be degraded so much. Therefore, a table populated with values that outputs the same gradation level as the image signal of the Nth frame if the difference in the gradation level between the image signal of the Nth frame and the image signal of the (N−1)th frame is within 0 to 12% of the total gradation may be set up. This way, degradation of the moving image quality due to correction errors can be prevented.

The image display device 1 may also include a writing unit (not shown) that, for example, stores the image signal of zero gradation level in the frame memory 4 before the first frame of the image signal is inputted to the image signal input section 2.

Further, when the image signal of the first frame is inputted to the image signal input section 2, the overshoot operation section 3 preferably corrects the gradation level of the image signal of the first frame according to the relation between the gradation level of the image signal written by the writing unit and the gradation level of the image signal of the first frame. Thus, the slow response time experienced when, for example, the image display device is turned on and the first image inputted is displayed can be improved.

Gradation Level Conversion After Frame Division

In the image display device 1, gradation level conversion performed by the sub-frame division processing section 5 after the frame division may be modified as appropriate according to the display characteristics of the image display panel 7, and the conversion may be performed using a conventionally known method.

In the present embodiment, the sub-frame division processing section 5 allocates the luminance to the respective sub-frames based on the image signal of the Nth frame whose gradation level has been corrected by the overshoot operation section 3, such that the sum of the time integrated values of the luminance in individual sub-frames in one frame period reproduces the luminance in one frame period set forth by the corrected image signal.

That is, when the image signal of the Nth frame is divided into two sub-frames, for one of the two sub-frames, conversion is conducted to provide a value lower than the gradation level in the one frame period, and for the other sub-frame, conversion is conducted to provide a value higher than the gradation level in the one frame period. Because the time integration value of the gradation levels of these two sub-frames is equal to the gradation level of the one frame period, display is perceived by the human eyes as having the same luminance as the image signal of the original Nth frame.

The gradation level allocation to the sub-frames is not especially limited. For example, if the gradation level of the image signal inputted to the image signal input section 2 is high, a gradation level of 0 or higher may be allocated to both the sub-frames. Here, by ensuring to provide the maximum possible difference in the luminance integration value between when the gradation level of the inputted image signal is at its maximum and when gradation level of the inputted image signal is at its minimum, the lowering of the contrast ratio can be avoided. Also, suitable impulse display can be achieved by allocating the lowest possible output gradation level to either of the sub-frames and allocating the highest possible output gradation to the other sub-frame.

Also, representation of the output gradation by the sub-frame division processing section 5 may be set such that, for example, the sum of the luminance of the image displayed on the image display panel 7 in the earlier and the later sub-frames, i.e., the luminance integration value for one frame, becomes equal to the display luminance of one frame of a normal sample-and-hold display, and such that one of the sub-frames displays a black screen (the lowest luminance) and the other sub-frame displays a white screen (the highest luminance). The sub-frame gradation level is not limited to the above-mentioned example.

Using a Table

In an image display device of the present invention, the above-mentioned correction unit preferably uses a table that relates the gradation level of the image signal of the above-mentioned frame and the corrected gradation level of the image signal of the frame immediately preceding the above-mentioned frame to the corrected gradation level of the image signal of the above-mentioned frame.

In the configuration described above, the correction unit can use the table when correcting the gradation level of the image signal for a frame. Therefore, by inputting the gradation level of the image signal of a frame and the corrected gradation level of the image signal of a frame immediately preceding the above-mentioned frame, the corrected gradation level is outputted. Thus, the correction can be performed efficiently.

Also, in the image display device of the present invention, the table may be preferably populated with values that emphasize the change in gradation level of the image signal if the gradation level of the image signal of a frame is higher than the corrected gradation level of the image signal of a frame immediately preceding the above-mentioned frame, and with values that provide the same gradation level as the image signal of the above-mentioned frame if the gradation level of the image signal of the above-mentioned frame is lower than the corrected image signal gradation level of the frame immediately preceding the above-mentioned frame.

In the configuration of the image display device described above, the gradation level of the inputted image signal of a frame and the gradation level of the image signal of the frame immediately preceding the above-mentioned frame are compared, and according to the magnitude relation of these gradation levels, the gradation level of the above-mentioned frame is corrected. Thus, the correction error can be reduced and the oscillation can be prevented.

In an image display device of the present invention, the table may be preferably populated with values that emphasize the change in the gradation level of the image signal of a frame if the image signal gradation level of the frame is lower than the corrected gradation level of the image signal of a frame immediately preceding the above-mentioned frame, and with values that provide the same gradation level as the image signal of the above-mentioned frame if the gradation level of the image signal of the above-mentioned frame is higher than the corrected gradation level of the image signal of the frame immediately preceding the above-mentioned frame.

In the configuration described above, because correction is performed to emphasize the gradation level change only if the gradation level of the image signal of a frame is lower than the corrected gradation level of the image signal of a frame immediately preceding the above-mentioned frame, correction errors can be reduced and the oscillation can be prevented.

Also, in an image display device of the present invention, the above-mentioned table may be preferably populated with values that provide the same gradation level as the image signal of the above-mentioned frame if the difference between the gradation level of the image signal of the above-mentioned frame and the corrected gradation level of the image signal of the frame immediately preceding the above-mentioned frame is within 0 to 12% of the total gradation.

In the above-mentioned configuration, if the difference in the gradation level between consecutive frames is small, the inputted image signal is outputted with the same original gradation level. That is, if the difference between the gradation level of the image signal of a frame and the gradation level of the image signal of a frame immediately preceding the above-mentioned frame is small, the quality of the moving image would not be considered degraded much. Therefore, the table is populated with values that provide the same gradation level of the image signal of a frame if the difference between the gradation level of the image signal of a frame and the gradation level of the image signal of a frame immediately preceding the above-mentioned frame is within 0 to 12% of the total gradation. Thus, degradation of the moving image quality due to correction errors can be prevented.

Judgment Unit

An image display device of the present invention may further include a judgment unit that determines the magnitude relation between the gradation level of the image signal of a frame and the gradation level of the image signal of a frame immediately preceding the above-mentioned frame, such that if the gradation level of the image signal of the above-mentioned frame is determined higher than the corrected gradation level of the image signal of the frame immediately preceding the above-mentioned frame, the correction unit corrects the gradation level of the image signal of the above-mentioned frame to emphasize the gradation level change, and if the gradation level of the image signal of the above-mentioned frame is determined lower than the corrected gradation level of the image signal of the frame immediately preceding the above-mentioned frame, the correction unit corrects the image signal of the above-mentioned frame to the same gradation level.

An image display device of the present invention may further include a judgment unit that determines the magnitude relation between the gradation level of the image signal of the above-mentioned frame and the corrected gradation level of the image signal of the frame immediately preceding the above-mentioned frame such that if the gradation level of the image signal of the above-mentioned frame is determined lower than the corrected gradation level of the image signal of the frame immediately preceding the above-mentioned frame, the correction unit corrects the gradation level of the image signal of the above-mentioned frame to emphasize the gradation level change, and if the gradation level of the image signal of the above-mentioned frame is determined higher than the corrected gradation level of the image signal of the frame immediately preceding the above-mentioned frame, the correction unit corrects the image signal of the above-mentioned frame to the same gradation level.

An image display device of the present invention may further include a judgment unit that determines the difference between the gradation level of the image signal of a frame and the corrected gradation level of the image signal of a frame immediately preceding the above-mentioned frame such that if the difference between the gradation level of the image signal of the above-mentioned frame and the corrected gradation level of the image signal of the frame immediately preceding the above-mentioned frame is determined to be within 0 to 12% of the total gradation, the correction unit corrects the image signal of the above-mentioned frame to the same gradation level.

According to the configuration described above, because the judgment unit determines the magnitude relation between the gradation level of the image signal of the above-mentioned frame and the corrected gradation level of the image signal of the frame immediately preceding the above-mentioned frame, and because the gradation level of the image signal of the above-mentioned frame is corrected based on the determination, degradation of the moving image quality due to the correction error can be prevented.

Display on Different Types of Liquid Crystal Display

An image display device of the present invention may further include a display unit that displays an image based on the corrected image signal of the above-mentioned frame that has been time-divided, and the display unit displays the image on a normally-black type liquid crystal display. Alternatively, an image display device of the present invention may further include a display unit that displays an image based on the corrected image signal of the above-mentioned frame that has been time-divided, and the display unit displays the image on a normally-white type liquid crystal display.

According to the configuration described above, the oscillation can be prevented and the effect of the response improvement can be enhanced in a manner suitable for the liquid crystal characteristics of the display to be used.

Image Display Device=Liquid Crystal Display Device

Preferably, an image display device of the present invention further includes a display unit that displays an image based on the corrected image signal of the above-mentioned frame that has been time-divided, and the display unit displays the image on a liquid crystal display.

According to the configuration described above, an image display device of the present invention can improve the slow response time of the liquid crystal elements, and therefore can provide an easy-to-view display.

Overshooting of the First Frame

Preferably, an image display device according to the present invention further includes a writing unit that instructs the storage unit to store an image signal of zero gradation level before the image signal of the first frame is inputted to the inputting unit, and when the image signal of the first frame is inputted to the inputting unit, the correction unit corrects the gradation level of the image signal of the first above-mentioned frame according to the relation between the gradation level of the image signal written by the writing unit and the gradation level of the image signal of the first frame.

In the configuration described above, when an image signal is inputted to the inputting unit for the first time, the correction unit retrieves an image signal whose gradation level is 0 from the storage unit. Using this image signal, the image signal of the first frame is corrected. As a result, the slow response time, which is experienced when, for example, the image display device is turned on and the first image inputted is displayed, can be improved.

Correction According to the Temperature

Preferably, an image display device of the present invention further includes a temperature detection unit that detects the ambient environmental temperature, where the correction unit corrects the gradation level of the image signal of the above-mentioned frame according to the detected environmental temperature.

In the configuration described above, the response time of the liquid crystal elements depends on the temperature. Therefore, the liquid crystal elements can be driven in a more suitable manner by correcting the image signal gradation level according to the detected temperature.

The present invention is not limited to the embodiments described above. Various modifications can be made within the scope defined by the appended claims, and embodiments that can be obtained by combining technological features disclosed in different embodiments are also included in the technological scope of the present invention.

Industrial Applicability

The present invention can be used for image display devices such as image display monitors, television receivers, personal computers with a built-in display, portable terminals, and display devices to be mounted in the car.

DESCRIPTION OF REFERENCE CHARACTERS

1 image display device
2 image signal input section (inputting unit)
3 overshoot operation section (correction unit)
4 frame memory (storage unit)
5 sub-frame division processing section (frame division unit)
6 image signal output section (display unit)
7 image display panel

The invention claimed is:

1. An image display device that time-divides one frame period of an image signal into a plurality of sub-frame periods to display images, comprising:

an inputting unit into which said image signal is inputted from outside one frame at a time;

a correction unit that corrects a gradation level of the inputted image signal for a frame;

a storage unit that stores the corrected gradation level of the image signal of said frame; and a frame division unit that time-divides the corrected and stored image signal of said frame into the plurality of sub-frame periods, wherein said storage unit already is storing the corrected gradation level of the image signal of a frame immediately preceding said frame when said correction unit corrects the gradation level of the image signal of said frame, and wherein said correction unit corrects the gradation level of the image signal of said frame in accordance with a relation between the corrected gradation level of the image signal of the frame immediately preceding said frame and the gradation level of the image signal of said frame.

2. The image display device according to claim 1, wherein said correction unit performs the correction using a table that relates the gradation level of the image signal of said frame and the corrected gradation level of the image signal of the frame immediately preceding said frame to the corrected gradation level of the image signal of said frame.

3. The image display device according to claim 2, wherein said table is populated with values that emphasize a gradation level change if the gradation level of the image signal of said frame is higher than the corrected gradation level of the image signal of the frame immediately preceding said frame, and with values that provide the same gradation level as the gradation level of the image signal of said frame if the gradation level of the image signal of said frame is lower than the corrected gradation level of the image signal of the frame immediately preceding said frame.

4. The image display device according to claim 3, further comprising a display unit that displays an image based on the corrected image signal of said frame that has been time-divided, wherein said display unit displays the image on a normally-black type liquid crystal display.

5. The image display device according to claim 2, wherein said table is populated with values that emphasize a gradation level change if the gradation level of the image signal of said frame is lower than the corrected gradation level of the image signal of the frame immediately preceding said frame, and values that provide the same gradation level as the image signal of said frame if the gradation level of the image signal of a said frame is higher than the corrected gradation level of the image signal of the frame immediately preceding said frame.

6. The image display device according to claim 5, further comprising a display unit that displays an image based on the corrected image signal of said frame that has been time-divided, wherein said display unit displays the image on a normally-white type liquid crystal display.

7. The image display device according to claim 2, wherein said table is populated with values that provide the same gradation value as the image signal of said frame if a difference between the gradation level of the image signal of said frame and the corrected gradation level of the image signal of the frame immediately preceding said frame is within 0 to 12% of a total gradation.

8. The image display device according to claim 1, further comprising a judgment unit that determines a magnitude relation between the gradation level of the image signal of said frame and the gradation level of the image signal of the frame immediately preceding said frame, wherein said correction unit corrects the gradation level of the image signal of said frame to emphasize a gradation level change if the gradation level of the image signal of said frame is determined higher than the corrected gradation level of the image signal of the frame immediately preceding said frame, and maintains the gradation level of the image signal of said frame to the same gradation level if the gradation level of the image signal of said frame is determined to be not higher than the corrected gradation level of the image signal of the frame immediately preceding said frame.

9. The image display device according to claim 1, further comprising a judgment unit that determines a magnitude relation between the gradation level of the image signal of said frame and the corrected gradation level of the image signal of the frame immediately preceding said frame, wherein said correction unit corrects the gradation level of the image signal of said frame to emphasize a gradation level change if the gradation level of the image signal of said frame is determined lower than the corrected gradation level of the image signal of the frame immediately preceding said frame, and maintains the gradation level of the image signal of said frame to the same gradation level if the gradation level of the image signal of said frame is determined to be not lower than the corrected gradation level of the image signal of the frame immediately preceding said frame.

10. The image display device according to claim 1, further comprising a judgment unit that determines a difference between the gradation level of the image signal of said frame and the corrected gradation level of the image signal of the frame immediately preceding said frame, wherein said correction unit corrects the image signal of said frame to the same gradation level if the difference between the gradation level of the image signal of said frame and the gradation level of the image signal of the frame immediately preceding said frame is determined to be within 0 to 12% of the total gradation.

11. The image display device according to claim 1, further comprising a display unit that displays an image based on the corrected image signal of said frame that has been time-divided, wherein said display unit displays the image on a liquid crystal display.

12. The image display device according to claim 1, further comprising a writing unit that instructs said storage unit to store an image signal of zero gradation level before the image signal of a first frame is inputted to said inputting unit, wherein when the image signal of the first frame is inputted to said inputting unit, said correction unit corrects the gradation level of the image signal of the first frame according to the relation between the gradation level of the image signal written by said writing unit and the gradation level of the image signal of the first frame.

13. The image display device according to claim 1, further comprising a temperature detection unit that detects ambient environmental temperature, wherein said correction unit corrects the gradation level of the image signal of said frame according to a detected environmental temperature.

14. A method for displaying images, wherein one frame period of an image signal is time-divided into a plurality of sub-frame periods to display images, the method comprising:

inputting the image signal from outside one frame at a time;

correcting a gradation level of the inputted image signal of a frame;

storing the corrected image signal of said frame to a memory; and time-dividing the corrected and stored image signal of said frame into the plurality of sub-frame periods, wherein, when correcting the gradation level of the image signal of said frame in the correction step, the memory is already storing the corrected image signal of the frame immediately preceding said frame, and wherein in said correction step, correction is conducted in accordance with the relation between the corrected gradation level of the image signal of the frame immediately preceding said frame, which is stored in the memory, and the gradation level of the image signal of said frame.

* * * * *